US007090119B1

(12) United States Patent
Lackey et al.

(10) Patent No.: US 7,090,119 B1
(45) Date of Patent: Aug. 15, 2006

(54) MAILBOX DOOR WITH RAIN INTERCEPTING STRUCTURE

(75) Inventors: Robert W. Lackey, Hickory, NC (US); Robert C. Beckmann, Vail, NC (US)

(73) Assignee: RWL Corporation, Hickory, NC (US)

( * ) Notice: Subject to any disclaimer, the term of this patent is extended or adjusted under 35 U.S.C. 154(b) by 0 days.

(21) Appl. No.: 11/042,280

(22) Filed: Jan. 25, 2005

(51) Int. Cl.
*B65G 11/04* (2006.01)

(52) U.S. Cl. ..... 232/45; 232/17; 232/38; 232/43.4

(58) Field of Classification Search ..... 232/17, 232/45, 43.1, 43.4, 38; D99/29; 220/849
See application file for complete search history.

(56) References Cited

U.S. PATENT DOCUMENTS 2,444,679 A * 7/1948 Shaukis ..... 232/35
4,367,844 A * 1/1983 Drummond ..... 232/17
5,664,729 A * 9/1997 Ladewig ..... 232/39
5,988,495 A * 11/1999 Lackey et al. ..... 232/17
6,719,195 B1 * 4/2004 Farentinos ..... 232/45
6,722,561 B1 * 4/2004 Thomas et al. ..... 232/39
6,808,108 B1 * 10/2004 Turnbow et al. ..... 232/29

* cited by examiner

*Primary Examiner*—William L. Miller
(74) *Attorney, Agent, or Firm*—Charles L. Schwab; Nexsen Pruet, LLC

(57) ABSTRACT

A mailbox is provided with a rain intercepting structure which includes a groove in a shoulder formed on the laterally opposite sides and the top of the mailbox door and a ridge on the inside of the mailbox doorway in juxtaposed registration with the groove. Moisture impacting the ridge is diverted to the groove and drains out its bottom ends, thus protecting the mail against rain damage.

5 Claims, 4 Drawing Sheets

MAILBOX DOOR WITH RAIN INTERCEPTING STRUCTURE

CROSS REFERENCE TO RELATED APPLICATIONS

Applicants have filed the following U.S. patent applications:

Ser. No. 11/024,265 filed Dec. 28, 2004 for a Ground Mount Post;

Ser. No. 11/032,964 filed Jan. 11, 2005 for a Mailbox and Support;

Ser. No. 11/047,977 filed Feb. 1, 2005 for a Mailbox with Signal;

Ser. No. 11/047,976 filed Feb. 1, 2005 for a Multiple Component Mailbox having a Postal and Newspaper Compartments;

Ser. No. 11/052,648 filed Feb. 7, 2005 for a Two Piece Mailbox Support, and

Ser. No. 11/052,591 filed Feb. 7, 2005 for a Reinforced Plastic Mailbox.

BACKGROUND OF THE INVENTION

Rural mailboxes have at least a front door hinged at its bottom near the mailbox floor and many also have a rear door hinged in a similar manner at the rear of the mailbox. The fit of the door accessed by the mail carrier should not be so tight as to be difficult for the mail carrier to open and close, however a loose fit can result in moisture entering the mailbox during a wind driving rainstorm. A need exists for a mailbox door structure, which intercepts and prevents entry of moisture into a mailbox but is not difficult to open and close. Since the mailbox door is opened and closed almost daily, the rain intercepting structure should preferably not be subject to wear or other deterioration.

BRIEF DESCRIPTION OF THE INVENTION

A door and doorway of the postal compartment of a mailbox are constructed to intercept wind driven rain and route it downwardly from the mailbox, thus preventing its entry into the interior of the postal compartment. The sides and top of the door and confronting portions of the postal compartment have a registering groove and ridge construction serving to deflect and drain rain driven by wind against the door. In a plastic mailbox construction the grooves and ridges are integrally molded into the mailbox door and the postal compartment housing to form a labyrinthine structure.

BRIEF DESCRIPTION OF THE DRAWINGS

An embodiment of the invention is illustrated in the accompanying drawings in which.

DETAILED DESCRIPTION OF THE INVENTION

Figure 1:
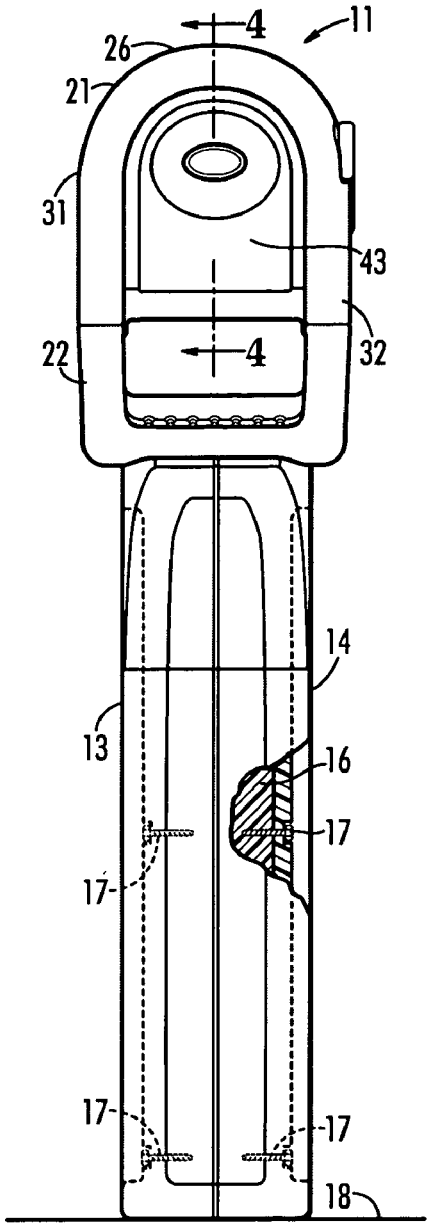
FIG. 1 is a front view of a plastic mailbox with parts broken away for illustration purposes.
Figure 2:
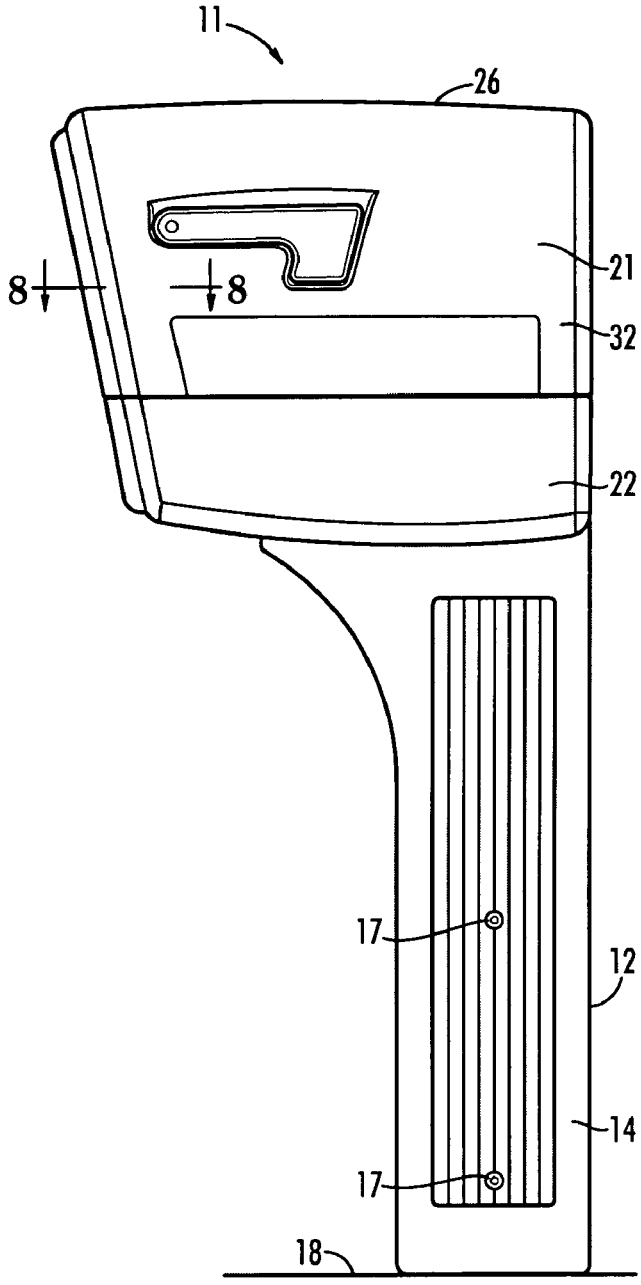
FIG. 2 is a side view of the mailbox.

FIGS. 1 and 2 show a double walled plastic mailbox 11 having a support 12, which has two side by side pieces 13, 14 secured by screws 17 to a wooden post 16 set in the ground 18. A postal compartment 21 is mounted on top of an open ended newspaper compartment 22 and is interconnected to the newspaper compartment 22 by a floor 23 shown in FIG. 3. The newspaper compartment 22 is secured to the upper end of the support 12 by suitable fasteners, not shown.

Figure 3:
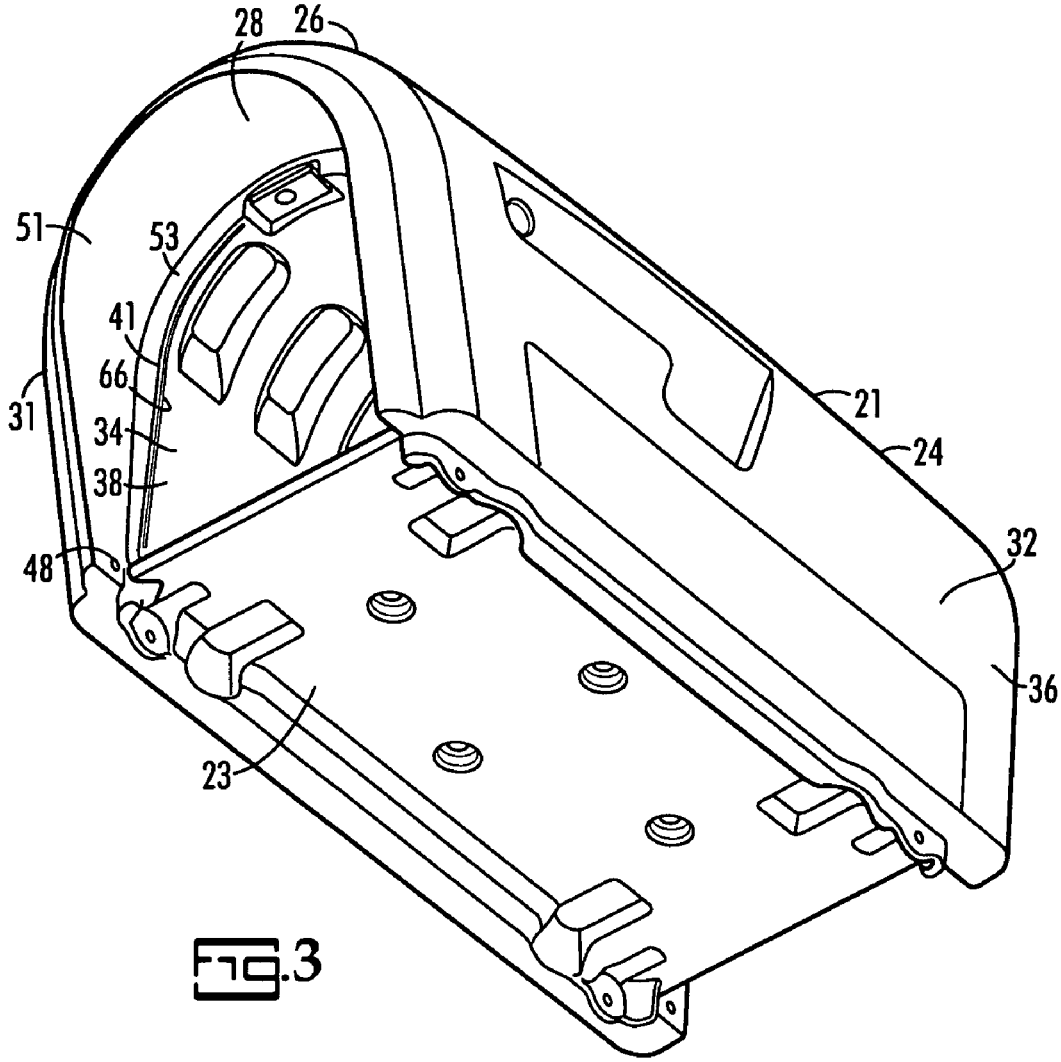
FIG. 3 is a perspective view of the postal compartment of the mailbox with the front door and signal removed.
Figure 4:
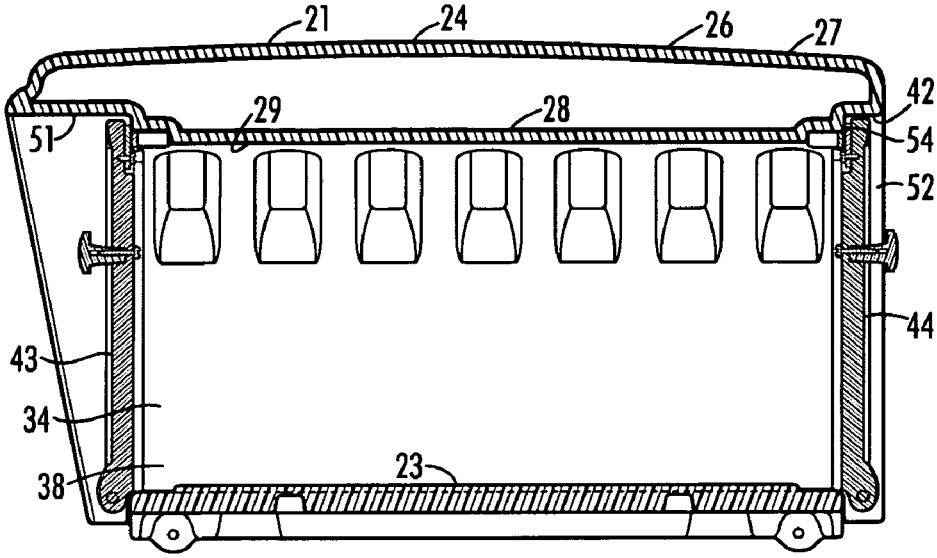
FIG. 4 is a section taken on line 4—4 in FIG. 1.
Figure 5:
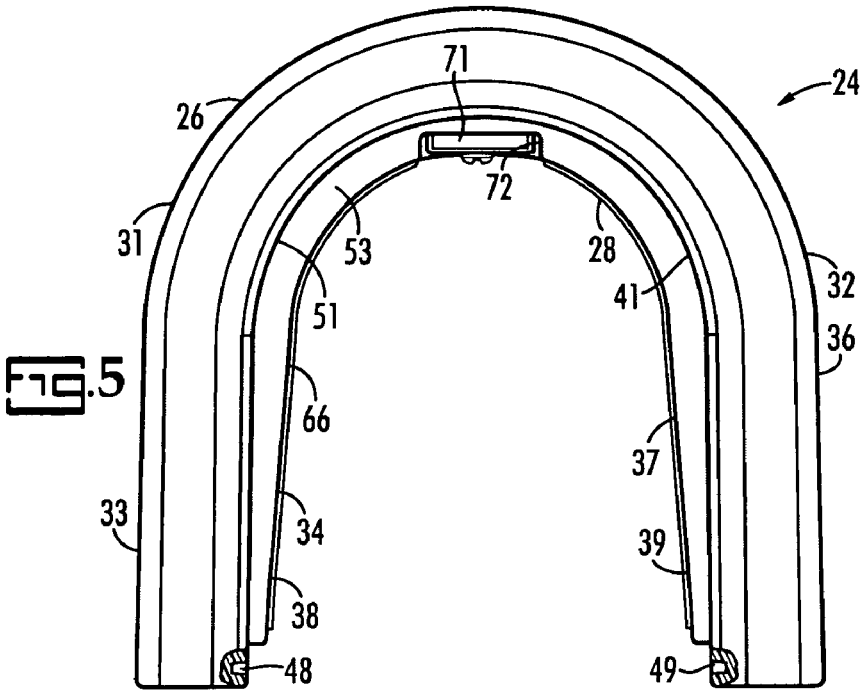
FIG. 5 is a front view of a housing component of the postal compartment without its floor.
Figure 8:
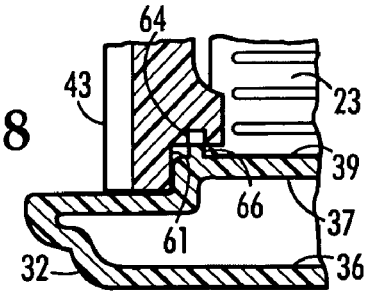
FIG. 8 is a partial section taken on the line 8—8 in FIG. 2.
Figure 6:
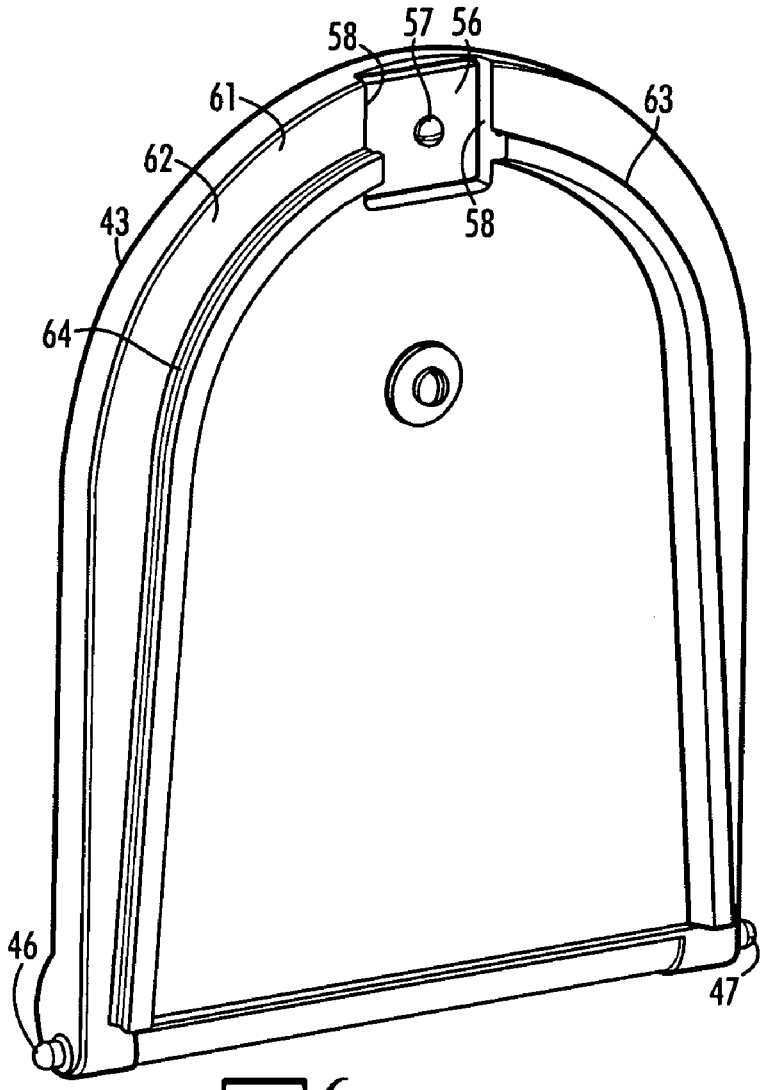
FIG. 6 is a perspective view showing the rear of the postal compartment door.
Figure 7:
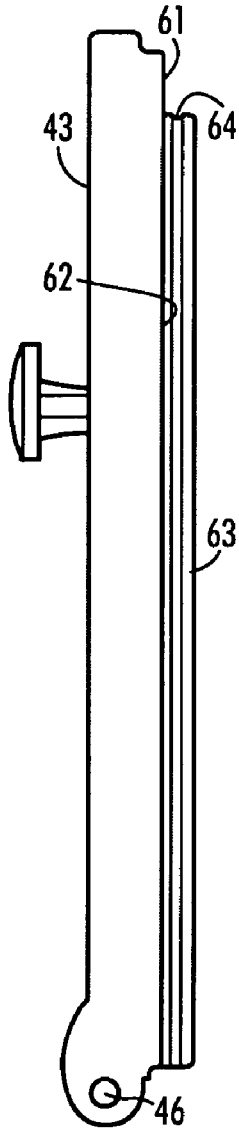
FIG. 7 is a side view of the postal compartment door.

Referring to FIGS. 3, 4 and 5, the postal compartment 21 includes a longitudinally extending housing 24 which has a double walled arched or arcuate roof 26 with an outer wall 27 and an inner wall 28 having a downwardly facing interior surface 29. The housing 24 also includes a pair of laterally spaced and longitudinally extending upright side walls or side wall structures 31, 32 which are also of double wall construction. The side wall structure 31 has a laterally outer wall 33 and a laterally inner wall 34 and, as shown in FIG. 8, the side wall structure 32 has an outer wall 36 and an inner wall 37. The inner walls 34, 37 have laterally confronting interior surfaces 38, 39 on their laterally inward sides. The inner wall 28 of the longitudinally extending arched roof 26 and the inner walls 34, 37 of the side wall structures 31, 32 form front and rear doorways 41, 42 for front and rear doors 43, 44. The doors 43, 44 each have integrally formed coaxial pivots extending outward from their laterally opposite lower ends or corners. FIGS. 6 and 7 show the pivots 46, 47 of the front door 43. The pivots extend into aligned bores or openings in the inner walls of the side wall structures 31, 32. The two openings or bores 48, 49 for the pivots of the front door 43 are shown in FIG. 5. Thus the front and rear doors 43, 44 pivot about parallel laterally extending horizontal axes.

The longitudinally opposite ends of the inner wall 28 of the roof 26 and the longitudinally opposite ends of the inner walls 34, 37 of the side wall structures 31, 32 define recesses 51, 52 with vertical shoulders 53, 54, respectively, at the longitudinally outer edges of the doorways 41 42.

As shown in FIGS. 4, 6, 7 and 8, an indentation 61 is formed in the top and laterally opposite edges of the inner side of the front door 43. The indentation 61 includes a vertical surface 62 and a shoulder 63 extending from the vertical surface 62 to the inward side of the door 43. The shoulder 63 includes a recess 64 which is in juxtaposed registration with an inward extending ridge or ridge structure 66 formed adjacent the doorway 41 on the inward facing sides of inner side walls 34, 37 and on the inward facing side of the inner wall 28 of the roof. A metal plate 56 is secured by a fastener 57 to the inside of the door 43 at a notch 58 at the top of the door 43. The notch 58 creates a gap or break in the vertical surface 62 and in the shoulder 63. The metal plate 56 engages a magnet 71 in a notch 72 in the inner wall 28 of the arched roof 26. The magnet 71 releasably hods the door in a closed position.

Wind driven rain entering the clearance between the front door 43 and its doorway 41 will be intercepted and diverted by the ridge 66 to the recess 64. Rain diverted to the recess 64 passes downwardly by gravity and out the bottom ends of the recess 64 terminating at the front of the postal box floor 23. The rear door 44 and its doorway 42 are constructed in the same manner as the front door 43 and its doorway 41. Thus the interior of the postal compartment is protected from driving rain at both its front and rear doorways.

What is claimed is:

1. A mailbox comprising:

a postal compartment housing including a roof having a downwardly facing surface, a pair of laterally spaced side walls extending downwardly from said roof, said side walls having laterally confronting upright surfaces on their laterally inward sides, said downwardly facing surface and said confronting upright surfaces defining a doorway, and a ridge structure extending downwardly from said downwardly facing surface of said roof and laterally inward from said confronting upright surfaces of said side walls, and a door in said doorway, said door having a front side and a rear side, said door being hinged at its lower end to said pair of laterally spaced side walls for movement between an open position and a closed position, an indentation formed on the top and laterally opposite edges of said rear side of said door, said indentation including a vertical surface and a shoulder extending from said vertical surface toward said ridge structure when said door is in said closed position, said shoulder having an outwardly opening recess formed therein and in juxtaposed registration with said ridge structure when said door is in said closed position.

2. The mailbox of claim 1 wherein said roof and said downwardly facing surface are arched.

3. The mailbox of claim 2 wherein said door has laterally opposite sides and wherein said recess extends to the lower ends of the laterally opposite sides of said door.

4. A plastic mailbox having longitudinally opposite ends comprising:

a postal compartment including a pair of laterally spaced and longitudinally extending upright side walls with laterally facing interior surfaces, and an arched roof integrally formed with said sidewalls presenting a downward facing interior surface on its underside, said side walls and roof forming an arched doorway at one of said longitudinal ends of said mailbox, and a ridge formed on said roof and said side walls, said ridge extending downwardly from said downward facing interior surface and extending laterally inward from said interior surfaces of said side walls adjacent said doorway and a door having a front side, a rear side, a bottom portion pivotally connected to said side walls for swinging movement about a horizontal axis between an open position and a closed position, an indentation formed on the top and laterally opposite edges of said rear side of said door, said indentation including a vertical surface and a shoulder extending from said vertical surface toward said ridge when said door is in said closed position, and an outwardly opening recess formed in said shoulder and in juxtaposed registration with said ridge when said door is in said closed position.

5. A plastic mailbox comprising:

a housing having a longitudinally extending arched roof with an exterior wall and an interior wall, a pair of laterally space longitudinally extending upright side walls, each having an exterior wall and an interior wall, said interior walls forming a front doorway and a rear doorway at their longitudinally opposite ends, respectively, and a ridge extending downwardly from said interior wall of said roof and extending inwardly from said interior walls of said side walls at each of said doorways, a front door at said front doorway, said door having a lower end pivotally connected to said housing on a first laterally extending horizontal axis for pivotal movement between open and closed positions, a rear door at said rear doorway having a lower end pivotally connected to said housing on a second laterally extending horizontal axis for pivotal movement between open and closed positions, each door having a front side and a rear side, an indentation formed on the top and laterally opposite edges of said rear side of each door, said indentation including a vertical surface and a shoulder extending from said vertical surface toward said respective ridge when said doors are in said closed positions, and an outwardly opening recess formed in said shoulder and in juxtaposed registration with said respective ridge when said doors are in said closed positions.

* * * * *